US006189273B1

(12) United States Patent
Larson

(10) Patent No.: US 6,189,273 B1
(45) Date of Patent: Feb. 20, 2001

(54) CONNECTOR CLIP FOR DRYWALL REVEAL

(75) Inventor: John A. Larson, Parkland, FL (US)

(73) Assignee: Plastic Components, Inc., Miami, FL (US)

( * ) Notice: Under 35 U.S.C. 154(b), the term of this patent shall be extended for 0 days.

(21) Appl. No.: 09/375,728

(22) Filed: Aug. 17, 1999

(51) Int. Cl.[7] ..... E04B 1/00
(52) U.S. Cl. ..... 52/255; 52/287.1; 52/469
(58) Field of Search ..... 52/255, 287.1, 52/417, 469, 459, 256, 257; 403/397, 398

(56) References Cited

U.S. PATENT DOCUMENTS 2,446,323 * 8/1948 Davis et al. ..... 52/543 X
3,408,782 * 11/1968 Kovacs ..... 52/459 X
5,740,642 * 4/1998 Koenig, Jr. et al. ..... 52/255
5,813,179 * 9/1998 Koenig, Jr. et al. ..... 52/255

FOREIGN PATENT DOCUMENTS

679523 * 10/1966 (BE) ..... 52/287.1

* cited by examiner

*Primary Examiner*—Janet M. Wilkens

(57) ABSTRACT

A drywall reveal and retaining clip for assuring proper alignment of abutting drywall reveal sections. The retaining clip comprises a generally U-shaped channel that engages the rear of two abutting ends of similarly shaped drywall reveal and by engagement of longitudinal ribs on the retaining clip with mating longitudinal channels on the drywall reveal provides a joint that aligns the abutting drywall reveal ends and inhibits any relative movement therebetween.

6 Claims, 2 Drawing Sheets

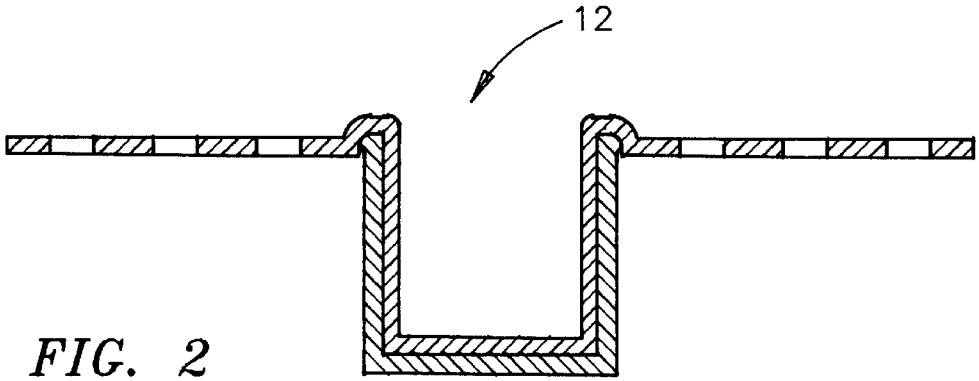
FIG. 2
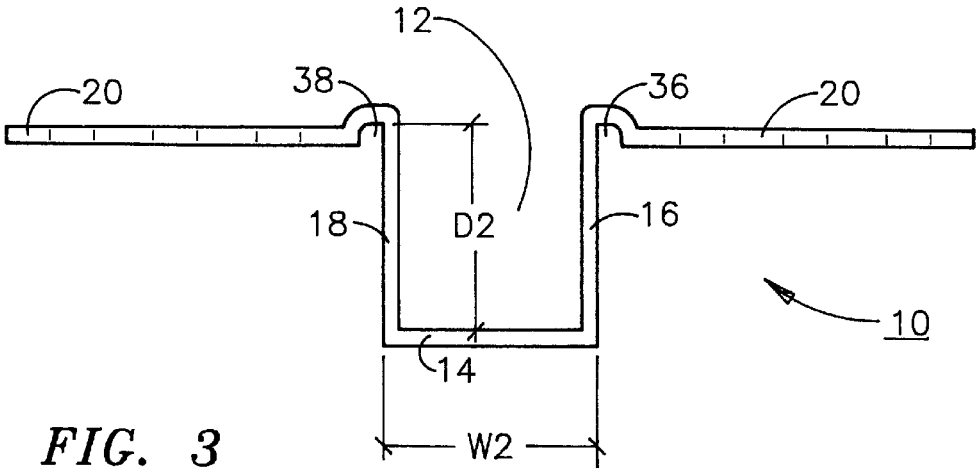
FIG. 3
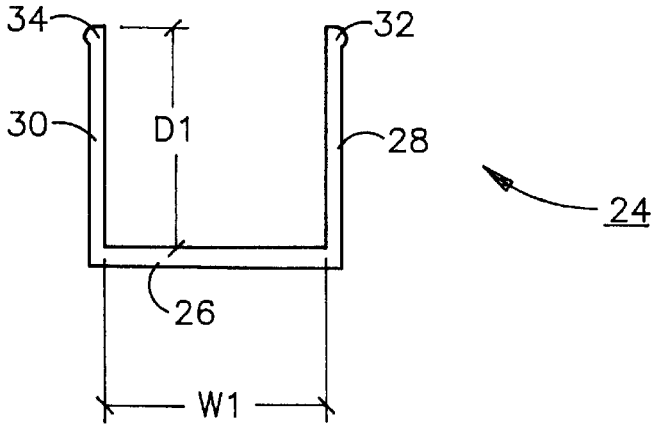

CONNECTOR CLIP FOR DRYWALL REVEAL

FIELD OF THE INVENTION

The present invention relates to reveals for use in drywall installation and more specifically to a connector clip for securing abutting drywall reveals.

BACKGROUND OF THE INVENTION

Drywall, direct applied and exterior insulation systems reveal is often used for decorative purposes or to achieve a wall break. In such situations, a U-shaped channel is inserted horizontally or vertically along the edge of the drywall between two drywall sections at the desired location to provide a recess. The U-shaped channel has opposing flanges running along its external longitudinal edges for engagement with the abutting drywall sections being separated by the reveal.

While such installations are relatively common, the problem often exists that when two sections of reveal are juxtaposed by butting their ends together there is an overlap of the two reveal ends. In such a case, subsequent finishing of the drywall surface leaves an unsightly irregularity on the finished surface.

OBJECTS OF THE INVENTION

It is therefore an object of the present invention to provide a solution to this misalignment problem.

It is another object of the present invention to provide a clip for attachment to abutting drywall reveal channels that assures their coplanar alignment in the installation process.

SUMMARY OF THE INVENTION

According to the present invention, there is provided a retaining clip for drywall reveal that, having the same general channel shape as and slightly larger dimensions than the reveal, engages the rear surfaces of abutting reveal sections and maintains them in proper coplanar alignment during the installation process.

According to a preferred embodiment of the present invention, the rear edges of the reveal are provided with longitudinal recesses that frictionally engage longitudinal ribs on the retaining clip in installation.

DESCRIPTION OF THE DRAWINGS

FIG. 2 is a cross-sectional view of the joint depicted in FIG. 1 along the line 2—2 of FIG. 1.

FIG. 3 is a blown apart view showing the retaining clip of the present invention as it is inserted onto the drywall reveal.

DETAILED DESCRIPTION

Figure 1:
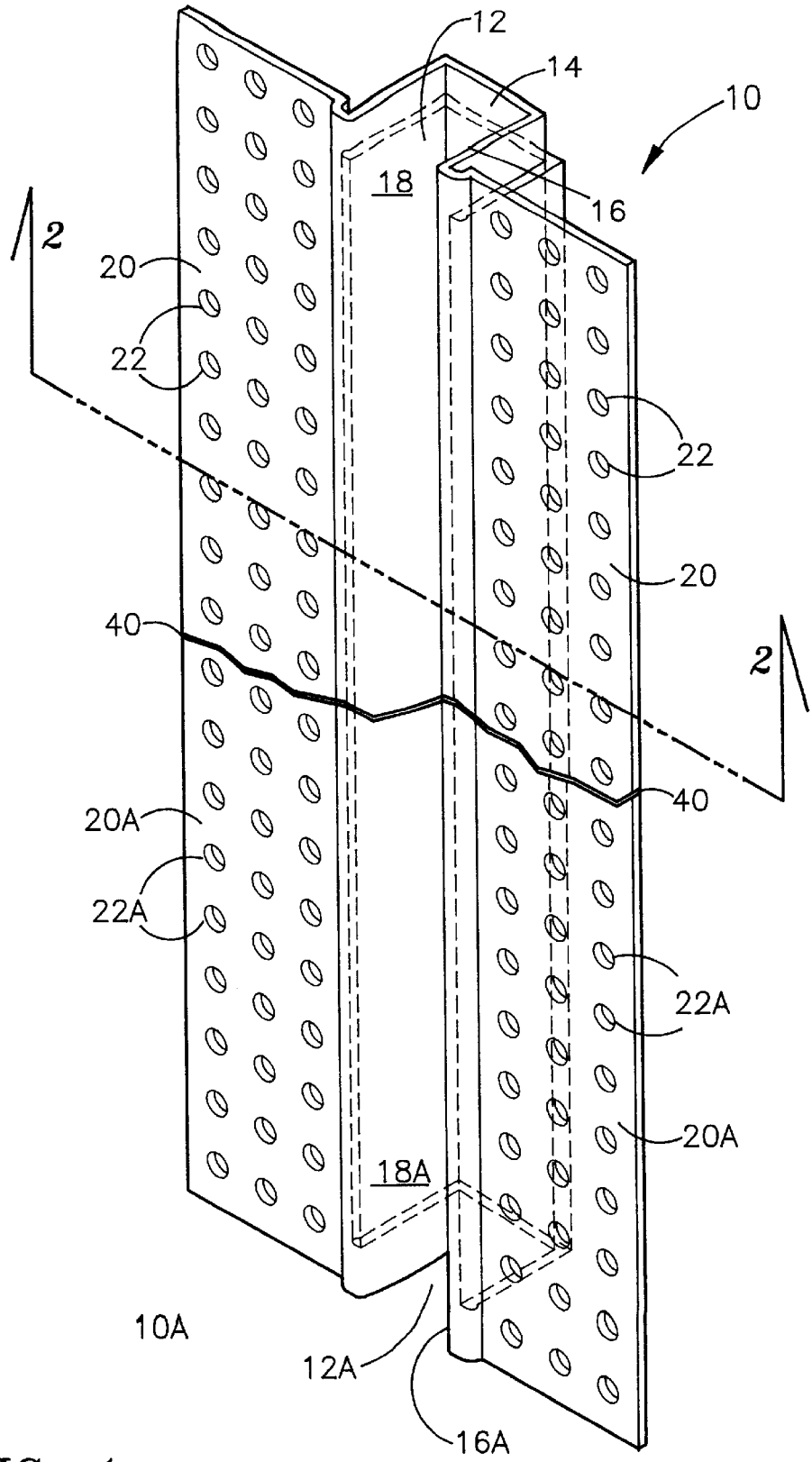
FIG. 1 is a perspective front view of a drywall reveal joint wherein the abutting ends of two separate reveal sections are held in coplanar position by the retaining clip of the present invention.

As shown in the drawings, drywall reveals 10 and 10A comprise elongated generally U-shaped channels 12 and 12A defined by bottom walls 14 and 14A and approximately parallel side-walls 16 and 16A find 18 and 18A extending at right angles from bottom walls 14 and 14A respectively. Each of drywall reveals 10 and 10A has horizontally extending flanges 20 and 20A extending from the outer edges of the open end of channels 12 and 12A. Flanges 20 and 20A both have holes 22 and 22A therein for receipt of drywall mud when the reveal is installed in the conventional fashion between two pieces of drywall.

As shown most clearly in FIG. 3, retainer clip 24 has the same generally U-shaped channel configuration as reveal 10 defined by bottom wall 26 and side-walls 28 and 30. The internal dimension W1 of retaining clip 24 is approximately the same as external dimension W2 of base wall 14 of reveal 10 so that retaining clip 24 can fit snugly over the outside of base wall 14 and side-walls 16 and 18. Similarly, depth D1 of retaining clip 24 must be approximately equal to depth D2 of the outside of side-walls 16 and 18 to permit proper engagement as described below.

At the top of side-walls 28 and 30 of retaining clip 24 are longitudinal ribs 32 and 34 designed to engage longitudinal recesses 36 and 38 located where side-walls 16 and 18 meet flanges 20 when retaining clip 24 is applied over reveal 10 from the rear or closed side of channel 12. Given this configuration, when, as shown in FIGS. 1 and 2, two reveals 10 and 10A are properly butted together and retaining clip 24 pressed into place at their rear so that the butt junction 40 of reveals 10 and 10A lies within the boundaries of retaining clip 24 and retaining clip 24 snapped into place such that longitudinal ribs 32 and 34 snap into longitudinal recesses 36 and 38, reveals 10 and 10A are secured in perfect alignment with no overlap which could result in an unsightly joint upon finishing.

Drywall reveals such as those depicted at 10 in the drawings are usually supplied in long lengths, eg 10' lengths. The retaining clips of the present invention can be supplied in any suitable length, but each joint of the type depicted in FIG. 1 will require only about 4–6" of retaining clip length. Thus the retaining clip can be supplied in long lengths that are cut to length on site or as individual 4–6" pieces.

Drywall reveal is normally supplied in depths, i.e. the depth of side-walls 16 and 18, equal to the thickness of the drywall with which they are being installed. Most commonly this is ½" and ⅝". However, the retaining clip of the present invention can be supplied to any depth to match that of the drywall reveal used.

The retaining clip 24 and reveals 10 may be fabricated from any number of suitable materials and using any of a number of fabricating processes. Specifically preferred for reasons of cost and ease of fabrication, handling and installation are polymeric materials such as PVC extrusion formed.

As the invention has been described, it will be apparent to those skilled in the art that the same can be varied in many ways without departing from the spirit and scope of the invention. Any and all such modifications are intended to be included within the scope of the appended claims.

What is claimed is:

1. In combination, a drywall reveal and a retaining clip, said drywall reveal comprising:

a) a generally U-shaped channel defined by a bottom wall and two generally parallel side-walls having top and bottom longitudinal edges and extending in the same direction at right angles from said bottom wall;

b) flanges extending at generally right angles away from said channel, parallel to said bottom wall and along said top longitudinal edges, said flanges being suitable for engaging abutting drywall; and c) longitudinal recesses along said top longitudinal edges where said flanges and said side-walls meet at the surface of said flanges nearest said side-walls; and said retaining clip comprising;

A) a generally U-shaped channel having a bottom wall and two generally parallel side-walls having top and bottom longitudinal edges and extending in the same direction at right angles from said bottom wall; and B) a longitudinal rib along each of said top longitudinal edges;

said drywall reveal and said retaining clip being designed such that when said retaining clip is placed over an end-to-end abutting pair of said drywall reveals, said longitudinal ribs engage said longitudinal recesses thereby providing an aligned and secure joint resistant to relative movement between said abutting pair of drywall reveals.

2. The combination of claim 1 wherein said drywall reveal side-walls have an exterior depth D1, said drywall reveal bottom wall has an external width W1, said retaining clip side walls have an interior depth D2, said retaining clip bottom wall has a width W2, D1 is approximately equal to D2 and W1 is slightly less than W2.

3. The combination of claim 2 wherein said retaining clip ranges in length from about 4 to about 6 inches.

4. A construction joint having a retaining clip securing a pair of end-to-end abutting drywall reveals, said drywall reveals each comprising:

(a) a generally U-shaped channel defined by a bottom wall and two generally parallel side-walls having top and bottom longitudinal edges and extending in the same direction at right angles from said bottom wall;

(b) flanges extending at generally right angles away from said channel, parallel to said bottom wall and along said top longitudinal edges, said flanges being suitable for engaging abutting drywall; and (c) longitudinal recesses along said top longitudinal edges where said flanges and said side-walls meet at the surface of said flanges nearest said side-walls; wherein said retaining clip comprises;

(A) a generally U-shaped channel having a bottom wall and two generally parallel side-walls having top and bottom longitudinal edges and extending in the same direction at right angles from said bottom wall; and (B) a longitudinal rib along each of said top longitudinal edges;

said drywall reveal and said retaining clip being designed such that when said retaining clip is placed over the end-to-end abutting pair of said drywall reveals, said longitudinal ribs engage said longitudinal recesses thereby providing an aligned and secure joint resistant to relative movement between said abutting pair of drywall reveals.

5. The retaining clip of claim 4 wherein said drywall reveal side-walls have an exterior depth D1, said drywall reveal bottom wall has an external width W1, said retaining clip side walls have an interior depth D2, said retaining clip bottom wall has a width W2, D1 is approximately equal to D2 and W1 is slightly less than W2.

6. The retaining clip of claim 5 ranging in length from about 4 to about 6 inches.

* * * * *